US009003566B2

(12) United States Patent
Weiss

(10) Patent No.: US 9,003,566 B2
(45) Date of Patent: Apr. 14, 2015

(54) ADJUSTABLE COLLAR STAY FOR A SHIRT COLLAR

(71) Applicant: Allan Weiss, Lyndhurst, NJ (US)

(72) Inventor: Allan Weiss, Lyndhurst, NJ (US)

( * ) Notice: Subject to any disclaimer, the term of this patent is extended or adjusted under 35 U.S.C. 154(b) by 0 days.

(21) Appl. No.: 13/973,423

(22) Filed: Aug. 22, 2013

(65) Prior Publication Data

US 2015/0052658 A1 Feb. 26, 2015

(51) Int. Cl.
*A41B 3/06* (2006.01)

(52) U.S. Cl.
CPC ..... *A41B 3/06* (2013.01)

(58) Field of Classification Search
CPC ..... A41B 3/06; A41B 3/08; A41B 1/14; A41B 7/08
USPC ..... 2/132, 134, 137, 138, 139, 140, 141.1, 2/141.2, 142, 255, 256, 257, 258, 259, 2/260, 231
See application file for complete search history.

(56) References Cited

U.S. PATENT DOCUMENTS

| | | | | | |
|---|---|---|---|---|---|
| 811,326 | A | * | 1/1906 | Reynolds | 2/134 |
| 983,260 | A | * | 2/1911 | Allen | 2/134 |
| 991,402 | A | * | 5/1911 | Windrich | 2/134 |
| 1,013,783 | A | * | 1/1912 | Krischer | 2/134 |
| 1,369,703 | A | * | 2/1921 | O'Connor | 2/132 |
| 1,381,733 | A | * | 6/1921 | O'Connor | 2/132 |
| 1,786,535 | A | | 12/1930 | Hillman | |
| 1,917,177 | A | | 7/1933 | Wolf | |
| 2,372,752 | A | | 4/1945 | Vaccarella | |
| 2,385,638 | A | | 9/1945 | Norwood | |
| 2,474,058 | A | | 6/1949 | McNeill | |
| 2,487,284 | A | | 11/1949 | Thomas | |
| 2,564,008 | A | | 8/1951 | Holt | |
| 2,595,112 | A | | 4/1952 | Story | |
| 2,595,122 | A | | 4/1952 | Burhans | |
| 2,639,436 | A | * | 5/1953 | Gavrilovich | 2/132 |
| 2,651,782 | A | * | 9/1953 | Oulouhojian | 2/132 |
| 2,659,892 | A | | 11/1953 | Sharp et al. | |
| 2,697,834 | A | * | 12/1954 | Robinson | 2/132 |
| 2,726,400 | A | * | 12/1955 | Ruane | 2/132 |
| 2,799,024 | A | | 7/1957 | Oscard | |
| 2,824,310 | A | | 2/1958 | Hedbrandh | |
| 2,899,681 | A | * | 8/1959 | Oscard | 2/132 |
| 2,936,461 | A | * | 5/1960 | Robinson | 2/132 |
| 2,964,756 | A | | 12/1960 | Liebowitz | |
| 3,039,112 | A | * | 6/1962 | Sucher | 2/132 |
| 3,064,270 | A | * | 11/1962 | Chalfin | 2/260 |
| 3,075,202 | A | | 1/1963 | Rubio | |
| 3,686,692 | A | * | 8/1972 | Snare et al. | 2/132 |

(Continued)

*Primary Examiner* — Alissa L Hoey
(74) *Attorney, Agent, or Firm* — Porzio, Bromberg & Newman, P.C.

(57) ABSTRACT

An adjustable collar stay having a base member and an extension member slidably engaged with the base member. The extension member can be adapted to extend from the base member by a predetermined length for matching a length of a collar into which the adjustable collar stay is inserted. The base member includes a plurality of first dimples on a top surface thereof. The extension member includes a plurality of second dimples on a bottom surface thereof. Alternatively the extension member includes a plurality of openings. When the extension member is slidably positioned to adjust the length of the adjustable collar stay to a predetermined length, the second dimples are positioned within spaces between the first dimples or the openings receive the first dimples for retaining the adjustable collar stay at the predetermined length. The extension member can be formed of flexible expandable mesh.

2 Claims, 3 Drawing Sheets

(56) References Cited

U.S. PATENT DOCUMENTS

| | | | | |
|---|---|---|---|---|
| 3,832,737 | A * | 9/1974 | Podolsky | 2/132 |
| 4,000,522 | A | 1/1977 | Swanson | |
| 4,975,983 | A | 12/1990 | Everett | |
| 5,626,267 | A | 5/1997 | Peruski | |
| 6,081,926 | A | 7/2000 | Krause et al. | |
| 6,089,422 | A | 7/2000 | Gibson | |
| 6,986,165 | B2 | 1/2006 | Neff et al. | |
| 7,614,101 | B2 * | 11/2009 | Milbourne | 5/490 |
| 8,220,075 | B2 * | 7/2012 | Chen et al. | 2/132 |
| 2005/0251891 | A1 | 11/2005 | Keeter | |
| 2005/0278826 | A1 | 12/2005 | Kato | |
| 2006/0218695 | A1 | 10/2006 | Boos | |
| 2007/0204374 | A1 * | 9/2007 | Bier et al. | 2/60 |
| 2009/0038049 | A1 * | 2/2009 | West | 2/132 |
| 2010/0088801 | A1 * | 4/2010 | Spiros | 2/132 |
| 2012/0227163 | A1 * | 9/2012 | Schottenstein | 2/255 |
| 2013/0247270 | A1 * | 9/2013 | Ross | 2/132 |

* cited by examiner

ADJUSTABLE COLLAR STAY FOR A SHIRT COLLAR

BACKGROUND OF THE INVENTION

1. Field of the Invention

The present invention relates to a collar stay which can be expeditiously adjusted to a variety of lengths to correspond to different size shirt collars.

2. Description of Related Art

Men's dress shirt collars come in various sizes. Typically, the dress shirts are sold with collar stays which are removable.

Adjustable collar stays have been described. U.S. Pat. No. 2,372,752 describes an adjustable shirt collar stay having arms and pivotally attached to a body that can be pivoted to vary the distance between the arms with a pin adjustably received in the body. An adjustment of the pin varies the length of the stay and an adjustment of the arms varies the width of the collar stay.

U.S. Pat. No. 2,564,008 describes a collar stiffener formed of stainless steel. A receiver part includes spaced apart arms with longitudinal slots in the lateral edges thereof. A received member has ratchet teeth to engage the arms and retain the received member at a particular position to change the length of the device. The teeth are disengaged by flexing the arms away from the slots.

U.S. Pat. No. 2,799,024 describes a collar stiffener formed of a first pointed member with two dimples and a blunt member with a vertical row of recesses. The members are formed of a flexible material such as spring brass or spring tempered Phosphor bronze. Each of the members are provided with a pair of ears to keep the two members clamped in close contact to one another to hold the members by spring pressure. The stay is extended or shortened by endwise pressure or pull on the stay. The pressure causes the members to bow with respect to each other in a region lying between the ears. The members when bowed allow disengagement of the dimples from the recesses and to allow motion of the members.

The above described collar stays use many mechanical parts and are cumbersome to adjust. It is desirable to provide a collar stay having minimal mechanical parts with low manufacturing costs. The adjustable collar stay can be readily adjusted to a precise length.

SUMMARY OF THE INVENTION

The present invention relates to an adjustable collar stay having a base member and an extension member slidably engaged with the base member. The extension member can be adapted to extend from the base member by a predetermined length for matching a length of a collar into which the adjustable collar stay is inserted. The base member includes a plurality of first dimples on a top surface thereof. The extension member includes a plurality of second dimples on a bottom surface thereof. When the extension member is slidably positioned to adjust the length of the adjustable collar stay to a predetermined length, the second dimples are positioned within spaces between the first dimples for retaining the adjustable collar stay at the predetermined length.

Alternatively, the extension member can have a shape including a plurality of openings for receiving a plurality of the dimples on a bottom surface of the base member. The openings can have a diamond shape for receiving and engaging certain of the plurality of dimples when the extension member is extended to a predetermined length. In one embodiment, the extension member is formed of a mesh material in which certain of the plurality of dimples are received in diamond pattern openings of the mesh material when the extension member is extended to a predetermined length. The mesh material can be formed of a flexible expandable material for allowing differing sizes of the base member to be inserted into one size of the extension member.

The invention will be more fully described by reference to the following drawings.

DETAILED DESCRIPTION

Figure 1:
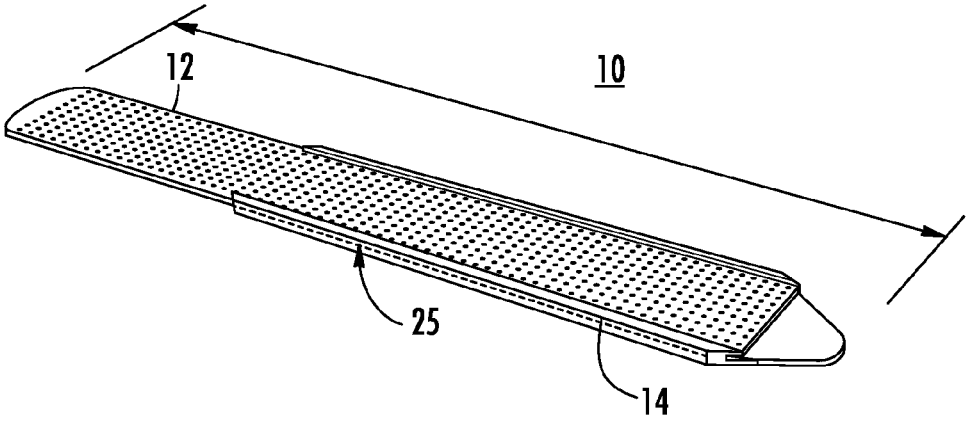
FIG. 1 is a schematic diagram of an adjustable collar stay of the present invention in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
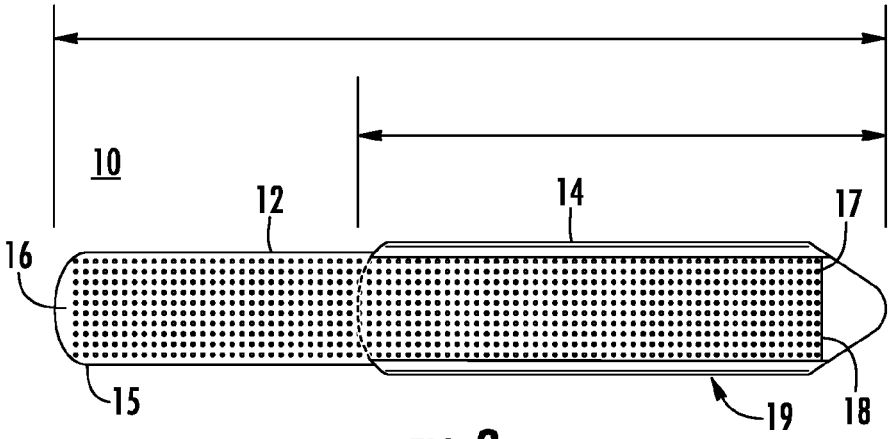
FIG. 2 is a schematic top perspective view of the adjustable collar stay.

Adjustable collar stay 10 includes base member 12 and extension member 14, as shown in FIGS. 1 and 2. Base member 12 includes a plurality of dimples 15 extending from top surface 16. In one embodiment, dimples 15 can be formed in a plurality of rows along the length of base member 12. Dimples 15 can be integral with base member 12.

Extension member 14 includes a plurality of dimples 17 extending from bottom surface 18. Extension member 14 can be used as a stay adjustment member. Dimples 17 can be formed in a plurality of rows along the length of body section 19 of extension member 14. Dimples 17 can be integral with extension member 14. Dimples 15 and 17 can be raised protrusions extending from a respective surface of base member 12 or extension member 14. Dimples 15 and 17 can have a conical shape.

Figure 3:
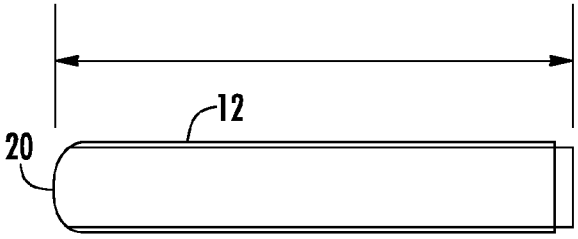
FIG. 3 is a bottom plan view of a base member of the adjustable collar stay.
Figure 4:
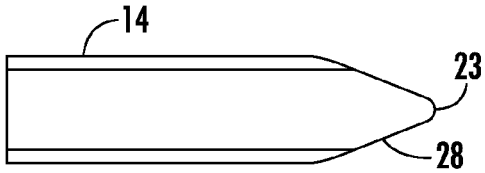
FIG. 4 is a top plan view of a stay adjustment member of the adjustable collar stay.

End 20 of base member 12 can be curved, as shown in FIG. 3. End 22 of extension member 14 can be angled into a curved point 23, as shown in FIG. 4.

Figure 5:
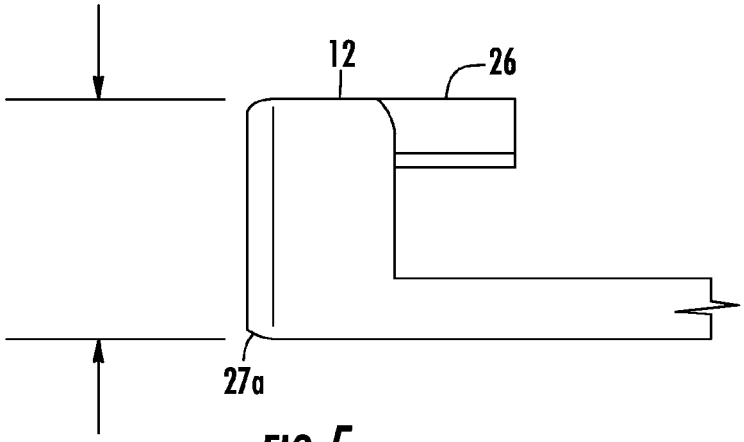
FIG. 5 is a detailed partial end view of the base member of the adjustable collar stay.
Figure 6:
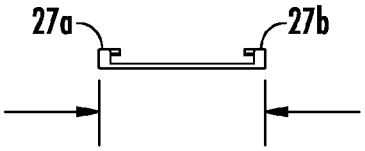
FIG. 6 is an end view of the base member of the adjustable collar stay.
Figure 7:
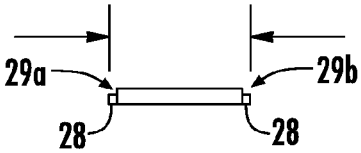
FIG. 7 is an end view of the stay adjustment member of the adjustable collar stay.

Lip 26 is formed in base member 12 along side edges 27*a*, 27*b*, as shown in FIGS. 5 and 6. Extension member 14 includes protrusions 28 along side edges 29*a*, 29*b*, as shown in FIG. 7. Protrusions 28 along edges 29*a*, 29*b* of extension member 14 slide within corresponding lips along edges 27*a*, 27*b* of base member 12 for adjustment of length $L_1$. Lip 26 retains extension member 14 within adjustable collar stay 10.

Figure 8A:
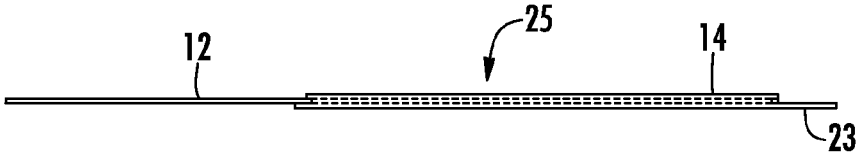
FIG. 8A is a schematic side view of the adjustable collar stay in a fully extended position.
Figure 8B:
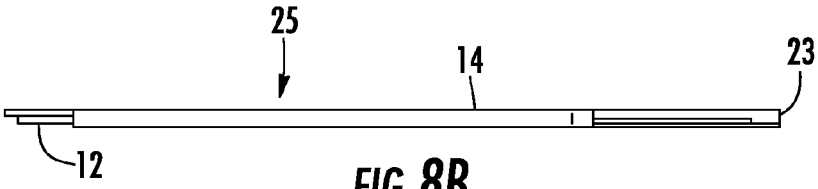
FIG. 8B is a schematic side view of the adjustable collar stay in a fully retracted position.

In a fully extended position shown in FIGS. 1 and 8A, dimples 17 of extension member 14 are positioned and retained in spaces between dimples 15 of base member 12 in coupling section 25 to adjust adjustable collar stay 10 to predetermined length $L_1$. The predetermined length $L_1$ can be expeditiously adjusted by sliding extension member 14 within base member 12 in the direction of arrows $A_1$ to thereby decrease the length of adjustable collar stay 10, as shown in FIG. 8B. The length of coupling section 25 is greater when adjustable collar stay 10 has a decreased length, as shown in FIG. 8B, than the length of coupling section 25 when adjustable collar stay 10 is fully extended as shown in FIG. 8A. The length of adjustable collar stay 10 can be adjusted to any length based on the length of base member 12 and extension member 14. For example, the length of adjustable collar stay 10 can be adjusted in a range of about 50 mm to about 90 mm, preferably 60 mm to about 80 mm to correspond to a length of a typical collar stay pocket of a shirt collar. It will be appreciated that adjustable collar stay 10 can be formed in various length for corresponding to typical lengths of shirt collars.

Dimples 15 and/or dimples 17 can be formed of a flexible material to allow dimples 17 to slide over dimples 15 upon the application of force on end 22 of extension member 14. Lip 26 can be formed of a flexible material and/or elastic material to apply pressure to protrusions 28 received within lip 26. Suitable materials for base member 12 and extension member 14 are plastic, flexible plastic, silicone, fabric, thermoplastic rubber (TPR) or thermoplastic material. Thermoplastic rubber (TPR) comprises materials with both thermoplastic and elastomeric properties. Suitable materials include copolymers or a mix of polymers, such as a plastic, and a rubber Alternative materials for base member 12 and extension member 14 are a flexible material such as brass or aluminum.

Figure 9A:
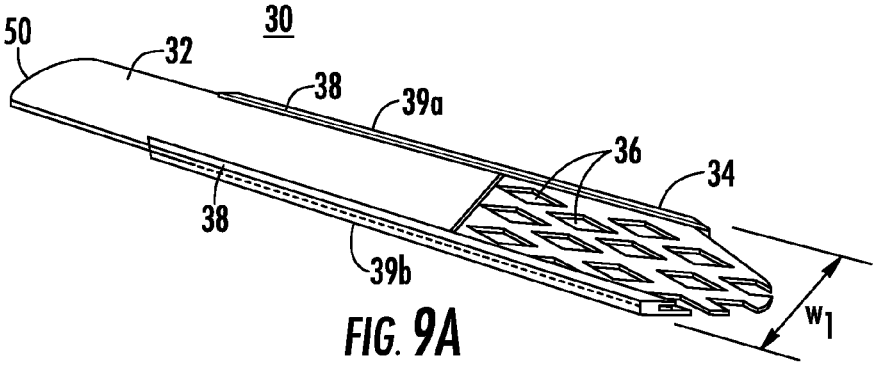
FIG. 9A is a perspective view of an alternate embodiment of the adjustable collar stay.
Figure 9B:
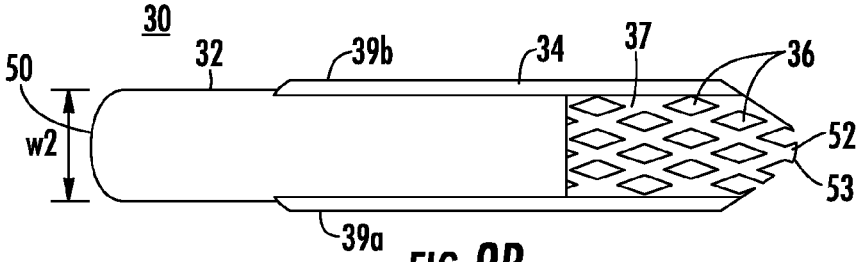
FIG. 9B is a top plan view of the adjustable collar stay shown in FIG. 9A.
Figure 9C:
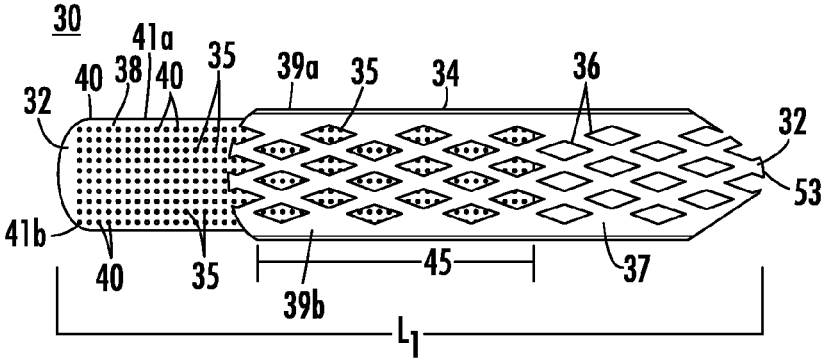
FIG. 9C is a bottom plan view of the adjustable collar stay shown in FIG. 9A.

Alternatively, adjustable collar stay 30 includes base member 32 and extension member 34, as shown in FIGS. 9A-9E. Base member 32 includes a plurality of dimples 35 extending from bottom surface 31 as shown in FIG. 9C. In one embodiment, dimples 35 can be formed in a plurality of rows along the length of base member 32. Dimples 35 can be integral with base member 32.

Extension member 34 can be used as a stay adjustment member. Extension member 34 includes a plurality of openings 36. Each of openings 36 can receive and engage certain of the plurality of dimples 35 extending from bottom surface 31 of base member 32 depending on the positioning of base member 32 within extension member 34, as shown in FIG. 9C. Openings 36 can have a diamond shape pattern for receiving and engaging a plurality of dimples 35 to expeditiously hold in place extension member 34 at the predetermined position for adjustment of length $L_1$. Extension member body 37 can be formed of a mesh material including openings 36 having a diamond shaped pattern. Openings 36 can alternatively have a different shape for example triangular, oval or rectangular or any corresponding shape for retaining dimples 35.

Figure 9D:
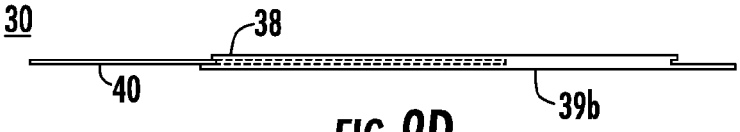
FIG. 9D is a side view of the adjustable collar stay shown in FIG. 9A.
Figure 9E:
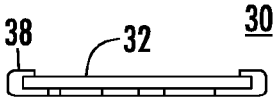
FIG. 9E is an end view of the adjustable collar stay shown in FIG. 9A.

Extension member 34 includes lip 38 along side edges 39*a*, 39*b*. Protrusions 40 can be positioned along edges 41*a*, 41*b* of base member 32, as shown in FIGS. 9C and 9D. Protrusions 40 slide within lip 38 for adjustment of length $L_1$. Lip 38 retains base member 32 within adjustable collar stay 30 as shown in FIG. 9E.

Extension member body 37 can be formed of a flexible expandable mesh material for allowing width $W_1$ of extension member body 37 to be expanded for receiving various sized widths $W_2$ of base member 32. For example, extension member body 37 can be expanded about 10% to about 25% for receiving various sized widths $W_2$ of base member 32. For example, base member 32 can have a width of either about 10 mm or about 12 mm and either width of base member 32 can be received within the same extension member 34 by expansion of extension member 34. Suitable materials for the mesh material include flexible plastic, silicone, fabric, thermoplastic rubber (TPR) or thermoplastic material.

Dimples 35 can have a predetermined pitch for allowing dimples 35 to engage openings 36. The predetermined length $L_1$ can be expeditiously adjusted by sliding base member 32 within extension member 34 in the direction of arrows $A_1$ to thereby decrease the length of adjustable collar stay 30. It will be appreciated that the length of coupling section 45 is greater when adjustable collar stay 30 has a decreased length than the length of coupling section 45 when adjustable collar stay 30 is fully extended. The length of adjustable collar stay 30 can be adjusted to any length based on the length of base member 32 and extension member 34.

End 50 of base member 32 can be curved. End 52 of extension member 34 can be angled into a curved point 53.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. An adjustable collar stay comprising:

a base member, said base member including a plurality of first dimples on a top surface thereof; and an extension member slidably engaged with said base member and extending from the base member, said extension member including a plurality of second dimples on a bottom surface thereof, said plurality of first dimples and said plurality of second dimples are arranged in a plurality of corresponding rows respectively along a length of said base member and along a length of said extension member, each of the plurality of corresponding rows along the length of the base member and the length of the extension member having respective said plurality of first dimples or said plurality of second dimples, the plurality of first dimples and the plurality of second dimples are raised conical protrusions, the plurality of first dimples extending from the top surface of the base member towards the plurality of second dimples extending from the bottom surface of the extension member, the plurality of first dimples are integral with the base member and are formed of a flexible plastic, silicone, thermoplastic rubber (TPR), or thermoplastic material and the plurality of second dimples are integral with the extension member and are formed of a flexible plastic, silicone, thermoplastic rubber (TPR), or thermoplastic material, said base member includes a lip formed along the length of either side edge and said extension member includes a protrusion along the length of either side edge, wherein the protrusions along the side edges of the extension member slide within the corresponding lip along side edges of the base member for adjustment of the predetermined length to adjust the length of said adjustable collar stay to a predetermined length and the plurality of second dimples are positioned within spaces between said plurality of first dimples for retaining the adjustable collar stay at the predetermined length.

2. The adjustable collar stay of claim 1 wherein an end of the extension member is angled into a curved point.

* * * * *